United States Patent [19]

Finsterwalder

[11] 4,275,679

[45] Jun. 30, 1981

[54] FLOATING PLATFORM WITH MONOLITHICALLY FORMED FLOAT MEMBERS AND PLATFORM

[75] Inventor: Ulrich Finsterwalder, München-Obermenzing, Fed. Rep. of Germany

[73] Assignee: Dyckerhoff & Widmann AG, Munich, Fed. Rep. of Germany

[21] Appl. No.: 956,286

[22] Filed: Oct. 31, 1978

Related U.S. Application Data

[63] Continuation of Ser. No. 819,054, Jul. 26, 1977, abandoned.

[30] Foreign Application Priority Data

Jul. 31, 1976 [DE] Fed. Rep. of Germany ..... 2634622

[51] Int. Cl.[3] ..... B63B 35/44

[52] U.S. Cl. ..... 114/264

[58] Field of Search ..... 114/65 R, 65 A, 77 R, 114/77 A, 264–267, 270; 52/231

[56] References Cited

U.S. PATENT DOCUMENTS

| | | | |
|---|---|---|---|
| 3,276,209 | 10/1966 | Mosdell | 114/266 |
| 3,444,693 | 5/1969 | Busey | 114/264 |
| 3,659,540 | 5/1972 | Toby et al. | 114/266 |
| 3,766,583 | 10/1973 | Phelps | 114/264 |
| 3,951,088 | 4/1976 | Hikai | 114/77 R |

FOREIGN PATENT DOCUMENTS

| | | | |
|---|---|---|---|
| 1516971 | 3/1968 | France | 114/265 |
| 411213 | 6/1934 | United Kingdom | 114/265 |
| 1444327 | 7/1976 | United Kingdom | 114/264 |

*Primary Examiner*—Trygve M. Blix
*Assistant Examiner*—Jesús D. Sotelo

[57] ABSTRACT

Floating platforms for various offshore facilities are formed of float members monolithically connected to a superposed platform. The float members are spherically shaped and are formed of reinforced or prestressed concrete. The platform can be a hollow planar member or it can be curved in one or two directions, and the platforms are formed of prestressed concrete. Cylindrical shafts can be used to connect the spherically shaped floats and the platform. Individual floating platforms can be connected by expansion joints and used as a runway. The float members can be constructed at the shoreline, launched into the water and held in a regular pattern while decked over with the platform. After completion of the construction procedure, the floating platform can be moved to an offshore location for use.

21 Claims, 13 Drawing Figures

FLOATING PLATFORM WITH MONOLITHICALLY FORMED FLOAT MEMBERS AND PLATFORM

This is a continuation of application Ser. No. 819,054 filed on July 26, 1977, now abandoned.

SUMMARY OF THE INVENTION

The present invention is directed to a floating platform and, more particularly, it concerns an arrangement of generally spherically shaped float members monolithically connected to a superposed platform.

At offshore locations, it is often a problem to provide a working or a traffic platform. Seaworthy platforms are necessary, for example, to sink boreholes for the exploration and extraction of oil and/or gas at offshore facilities which may be just off the coastline or at locations on the high seas. These offshore platforms are often provided with facilities for processing the raw materials and in the case of natural gas for liquefying gas so that it can be shipped. Such platforms should include docking facilities for a ship and landing facilities for airplanes, as well as storage facilities for the raw materials which are at least of a size to hold an amount comparable to the capacity of a large cargo vessel. Additionally, the storage facility should include the necessary transfer equipment for loading the raw materials into a vessel. Finally, shelters are required for the personnel working on the platform.

There are three types of offshore platforms. One type of platform can be supported on float members resting on the water surface. Another type of platform is identified as a semi-submersible floating platform, where the platform is supported on float members which extend below the water so that they are not influenced to any marked extent by wave movement. The third type of platform is an artificial island which rests on the ocean bottom.

In float members which float on the water surface, such as a pontoon, the surface area at the water line, that is, the base area of the float members at the water level, is large compared to the general base area of the float members. As a result, these float members are greatly exposed to wind and wave movements causing vibrations to be generated within the platform. Such vibrations are unfavorable for the installation of the platform and for its operation.

In a semi-submersible floating platform, the platform is supported on slender columns which bear on the semi-submersed float members. In such an arrangement, the waves act directly only on the columns. The surface area at the water line is small in such semi-submersible floating platforms as compared to the base area of the float members themselves. Accordingly, the influence of the waves on the floating stability of the semi-submerged floating platform is less than when the float members bear on the water surface. Such semi-submersible floating platforms have the disadvantage, however, that they must be trimmed very accurately and they tend to react very sensitively to varying load distributions. Another disadvantage is that the relatively deep draft of the float members causes problems both in the manufacture and operation of the semi-submersible floating platform.

All of these types of floating platforms used in the past have the common characteristic of being extremely elaborate with regard both to their costs of manufacture and the type of manufacture involved. Due to the size of these installations and their draft, elaborate docking installations are required for their manufacture or at least locations along a shoreline having a great depth of water are needed. As a result, the installations cannot be built at any location and, in addition, they require a long period of construction.

Therefore, the primary object of the present invention is to provide a floating platform with properties corresponding substantially to those of semi-submersible floating platforms which are not exposed or are exposed only to a minor extent to vibrations caused by wave movements and which have much smaller material costs and can be built in a shorter period of time at locations where the water depth is relative shallow.

In accordance with the present invention, the platform consists of a prestressed concrete slab without any joints with the slab prestressed in each of two directions. Further, the platform is monolithically connected to the float members formed as closed bodies of revolution having a curved generatrix and constructed of reinforced concrete or prestressed concrete.

Preferably, the float members are spherically shaped and connected directly with the lower surface of the platform. Preferably, an upper portion of the spherical member is cut off to provide the interconnection. It is also possible to interconnect the upper end of a float member and the platform by means of a cylindrical shaft. In one embodiment of the invention, the platform can be constructed as a planar hollow slab with a continuous top and bottom slab. The interior of the hollow slab can be divided by bulkhead partitions into a number of hollow chambers. The partitions are preferably arranged in a narrow egg crate-like arrangement relative to the size of the platform.

In another embodiment, the platform can be curved in one or two directions, that is, where the directions extend generally perpendicularly to one another. Preferably, the platform is in the form of a spherical shell open at its upper side. The open space within the shell is divided by ribs into a number of individual compartments. The ribs can be arranged to extend radially and/or circularly of the center of the platform, such as when the circumferential periphery of the platform is circular. The upper edges of the ribs can be arranged in a stepped arrangement extending outwardly from the center of the platform giving the appearance of an amphitheater.

In one embodiment, the platform is rectangular in shape, preferably having a square base area, and its float members are disposed in parallel rows. The platform can also have a polygonal base area or, preferably, it can be circular, in which case the floats can be arranged in radially spaced concentric circles.

It is preferable to dimension the platform to correspond substantially to the size of the waves it will experience.

Both the float members themselves and the hollow spaces within the platform slab can be used as tanks for storing liquids, such as crude oil or liquid gas or holding ballast. Further, the platforms can be used as a route for traffic or as a runway.

The floating platform embodying the present invention is kept afloat on the water surface by a plurality of float members preferable spherical in form. Depending on the load, the float members extend partly below the water surface and the surface of the float member at the water surface is considerably smaller than the base area of the platform. With such an arrangement, the force of the waves striking the floating platform is less than in the case of a one-part float member, that is, a pontoon of the same size as the platform. If a platform with a base area of 150×150 m is carried by 16 spherically shaped float members each having a diameter of 26 m and a wall thickness of 0.20 m, the area of the float member at the water surface is only about 38% of the base area of the platform and, accordingly, the force of the waves striking the floating platform is only about 38% of what it would be if a single pontoon of the same area as the platform were used as the float member.

The floating platform can be used in any desired manner. Accordingly, it can be used as a support for boring frames and for plants for processing the raw materials and for the collection and liquefaction of natural gas. Further, the platform can also be used as a berth for tankers and other transport vessels. At the same time, however, the float members can be used as tanks for the intermediate storage of oil and natural gas and the safety of such an arrangement is greater than in comparable known installations, because the tanks formed by the float members are separated from the installations on the platform by a solid concrete slab. With the above indicated dimensions, the platform can carry equipment, for example, of 10,000 t for the liquefaction of gas, and 70,000 t of crude oil or 140 cu m of liquid gas. This amount permits loading a tanker having a low capacity of 125,000 cu m of liquid gas.

The platform can be constructed with a working surface or slab of any desired length. With such a slab, the platform can form a floating runway for airplanes which can be used at deep water locations. Such a runway platform can be turned into the direction of the wind and it causes no displacement due to undesired landings.

Another essential advantage of the floating platform embodying the present invention, is that it can be constructed without the use of a boat yard or drydock facilities in a simple manner and without any elaborate auxiliary equipment. Accordingly, the invention also concerns a method of producing a floating platform where the float members are first constructed and after being assembled in a predetermined arrangement, the platform or slab is poured over the float members with a monolithic connection to them.

In carrying out this method it is preferable to use an arrangement including a number of basins open to the free water surface along a shore line so that a row of float members can be constructed and launched into a position where they are held between wharves or jetties on which scaffolding can be mounted along with forms for pouring the platform.

Such an arrangement has the advantage that the platform, regardless of its size, can be produced in a series manner in a short period of time with a relatively low cost compared to the construction of a ship of a similar volume. The cost advantage compared to a ship results from the small amount of building materials used, the low investment costs, and the possibility of producing the spherically shaped float members in a series operation using simple and mechanized equipment, for example, climbing formwork. The float members themselves are formed as shells of reinforced concrete which are only stressed in compression.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
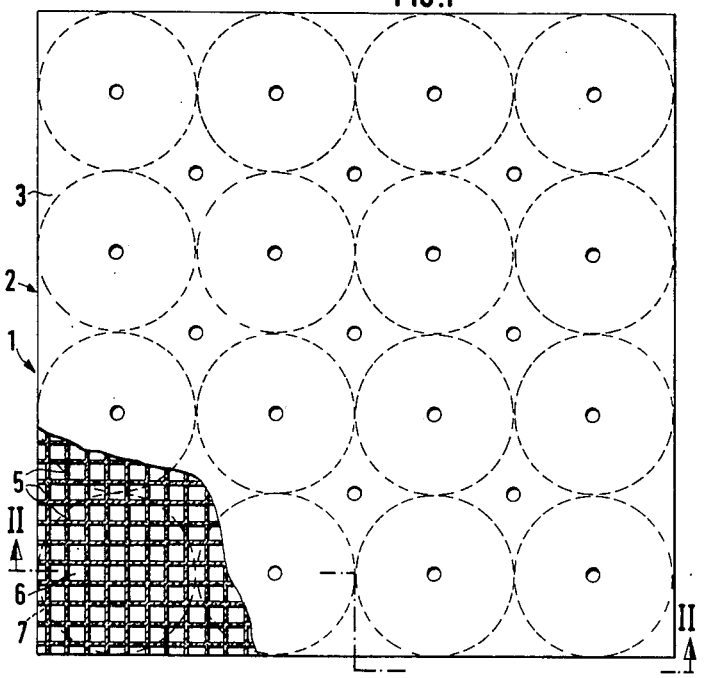
FIG. 1 is a plan view with a portion broken away and shown in section, of one embodiment of a floating platform incorporating the present invention with the platform in the form of a hollow slab.
Figure 2:
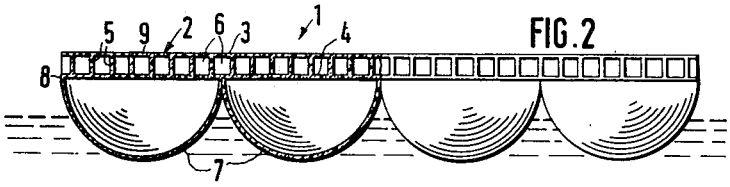
FIG. 2 is a cross sectional view taken along the line II—II in FIG. 1.

FIGS. 1 and 2 disclose a first embodiment of a floating platform incorporating the present invention. In FIG. 1 the platform slab is shown with a portion of the upper slab broken away. Floating platform 1 consists of a planar hollow slab 2 with the hollow slab including an upper slab 3 and a lower slab 4 interconnected and reinforced by bulkhead partitions 5. The upper slab 3 and lower slab 4 along with the bulkhead partitions 5 are constructed of prestressed concrete and form closed hollow spaces or chambers 6 which can be used for various purposes, for example, for ballasting the platform with water.

Hollow slab 2 has a square base and is supported on a total of sixteen float members 7. The float members 7 are in the form of thin-walled hemispheres of reinforced concrete. These hemispheres are monolithically connected about their upper edges 8 with the lower slab 4 of the hollow slab 2. Openings 9 are provided in the hollow slab 2 for filling the chambers within the float members 7.

Figure 3:
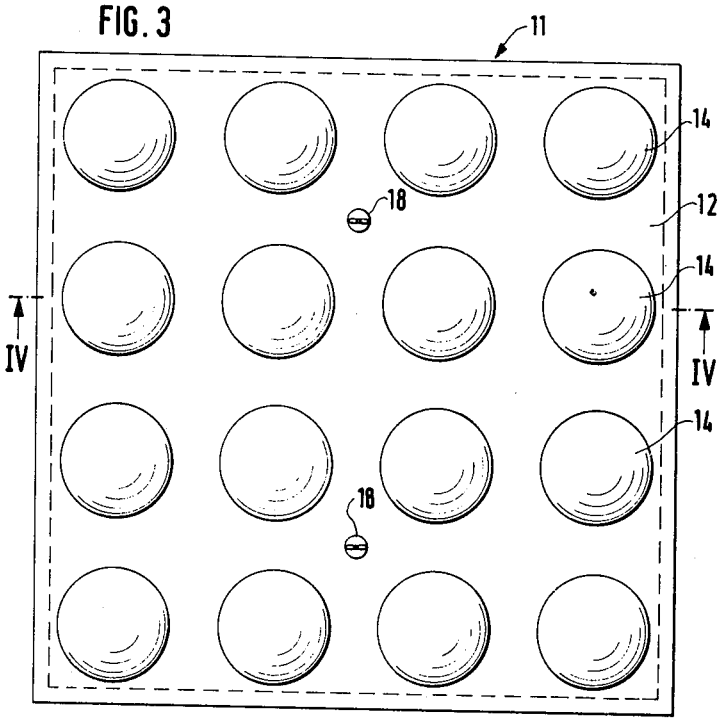
FIG. 3 is a plan view of another embodiment of a floating platform incorporating the present invention with the platform having a square shaped base and with the base being curved in each of its two directions.
Figure 4:
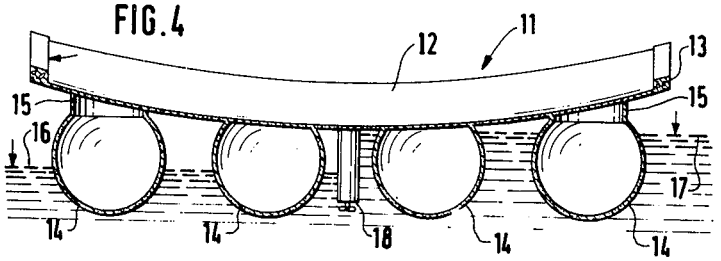
FIG. 4 is a cross sectional view taken along the line IV—IV in FIG. 3.

Another embodiment of the floating platform 11 is displayed in FIGS. 3 and 4 with FIG. 3 providing a bottom view and FIG. 4 a sectional view of the platform which is curved in the form of a ball shaped cup open at the top and provided with a reinforced border 13. With the platform or curved shell 12 curved in both directions, an improved supporting effect is afforded with the rigidity of the floating platform being increased while the material used is reduced. This particular platform is especially suitable for locations which have great wave heights. The platform or shell 12 is formed of prestressed concrete. Supporting the shell 12 are a plurality of float members 14 each having the shape of $\frac{3}{4}$ of a sphere, that is, each of the spheres have a segment removed across its upper end with the segment having an angle of about 45°. Float members 14 float by themselves, since the center of gravity of a $\frac{3}{4}$ ball is below its metacenter. To assure that each of the floats is at the same bottom level, because of the curved configuration of the slab or shell 12, the outer ones of the float members are provided with a vertically extending cylindrically shaped shaft 15 interconnecting the float member with the shell. The float members are formed of reinforced concrete. In this embodiment the inner chambers of float members 14 can be filled with liquid, for instance, crude oil or liquid gas. In FIG. 4, the water level 16 is shown in the empty state of the floating platform while the water level 17 indicated the loaded state of the platform.

Any desired superstructure can be positioned on the platform, such as a derrick, a liquefying plant for natural gas, helicopter landing pad, shelters for operating personnel, and the like. Furthermore, the floating platform can be provided with driving engines permitting it to be positioned or moved. The driving engines 18 are shown in FIGS. 3 and 4.

Figure 6:
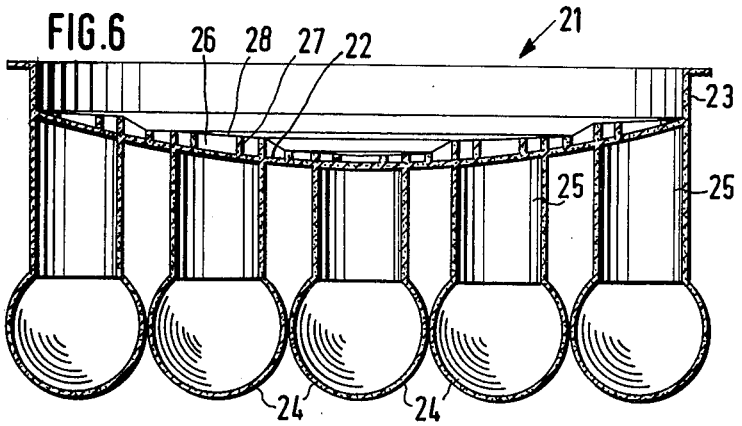
FIG. 6 is a cross sectional view taken along the line VI—VI in FIG. 5.
Figure 5:
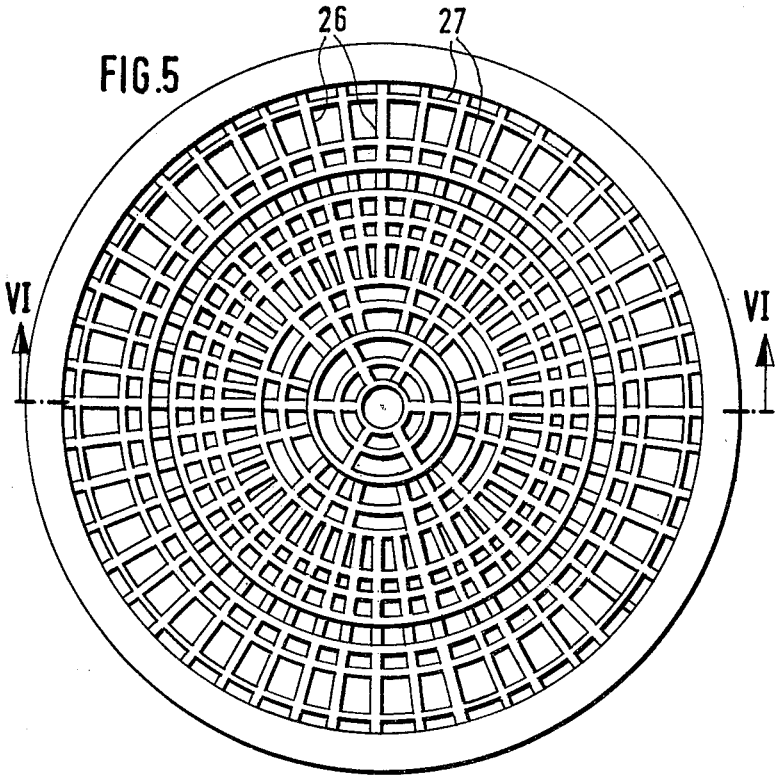
FIG. 5 is vertical sectional view of still another floating platform embodying the present invention with the platform being curved in two directions and having a circular periphery.

FIGS. 5 and 6 represent still another embodiment of the invention with FIG. 5 affording a top view and FIG. 6 providing a sectional view. Floating platform 21 has a circular periphery and is formed of a shell 22 curved in both directions. The shell is constructed of prestressed concrete and its peripheral edge is defined by a vertical edge beam 23 forming a lateral cylindrical wall. A bending resistant connection between the float members 24 and the shell 23 is afforded by vertically extending cylindrically shaped hollow shafts 25.

To provide an improved arrangement for supporting a refinery or liquefying plant on the floating platform, which equipment is not illustrated for clarity's sake, an intersecting arrangement of radially extending ribs 26 and circularly extending ribs 27 is provided extending upwardly within the open upper portion of the shell 22. The upper edges 28 of the ribs 26 and 27 rise from the center of the shell outwardly toward the beam 23 in the manner of an amphitheater, note FIG. 6. These ribs 26 and 27 also provide stiffening for the shell 22.

Figure 7:
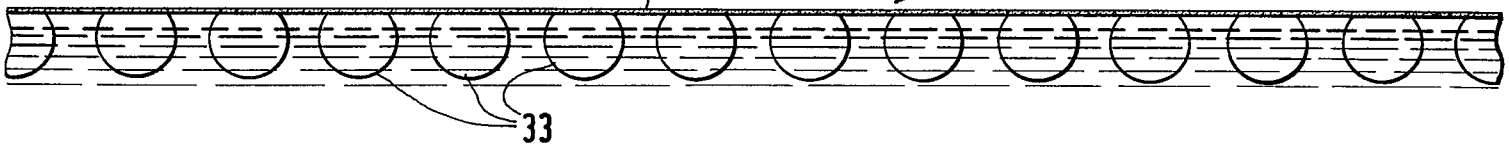
FIG. 7 is an elevational view, partly in section, displaying a floating runway embodying the present invention.
Figure 8:
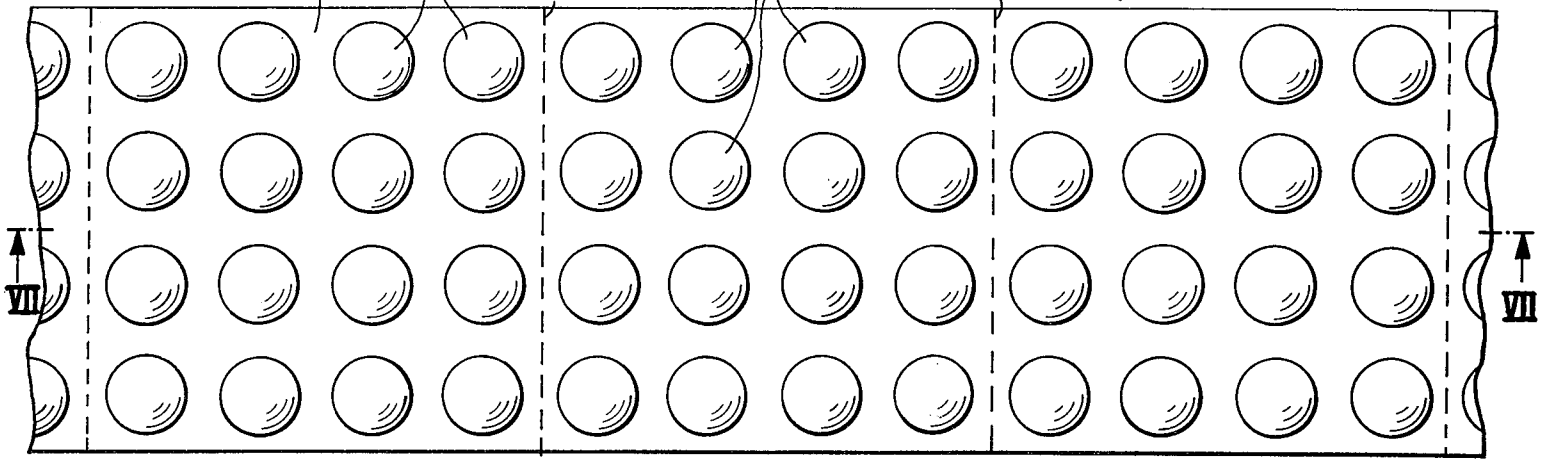
FIG. 8 is a bottom view of the floating runway illustrated in FIG. 7.

Compared to floating platform 1, which has its platform in the form of a hollow slab, the floating platforms 11 and 21 are constructed as shells, since a solid planar slab can only be used for limited wave heights of up to about 4 m because of its limited bending resistance. A planar slab can be used, for example, as a runway in relatively calm water. Such an embodiment is shown in FIGS. 7 and 8. Floating platform 31 consists of a planar slab 32 formed of prestressed concrete and supported on spherically shaped floats 33. The floating platform or runway has a width of about 150 m and a length of about 3200 m and the slab has a thickness of about 0.60 m. The floating platform can be constructed of individual sections separated by the expansion joints 34, note FIG. 8.

In FIGS. 9–13 installations are shown for constructing the float members and for the assembly of the float members into a floating platform member.

Figure 9:
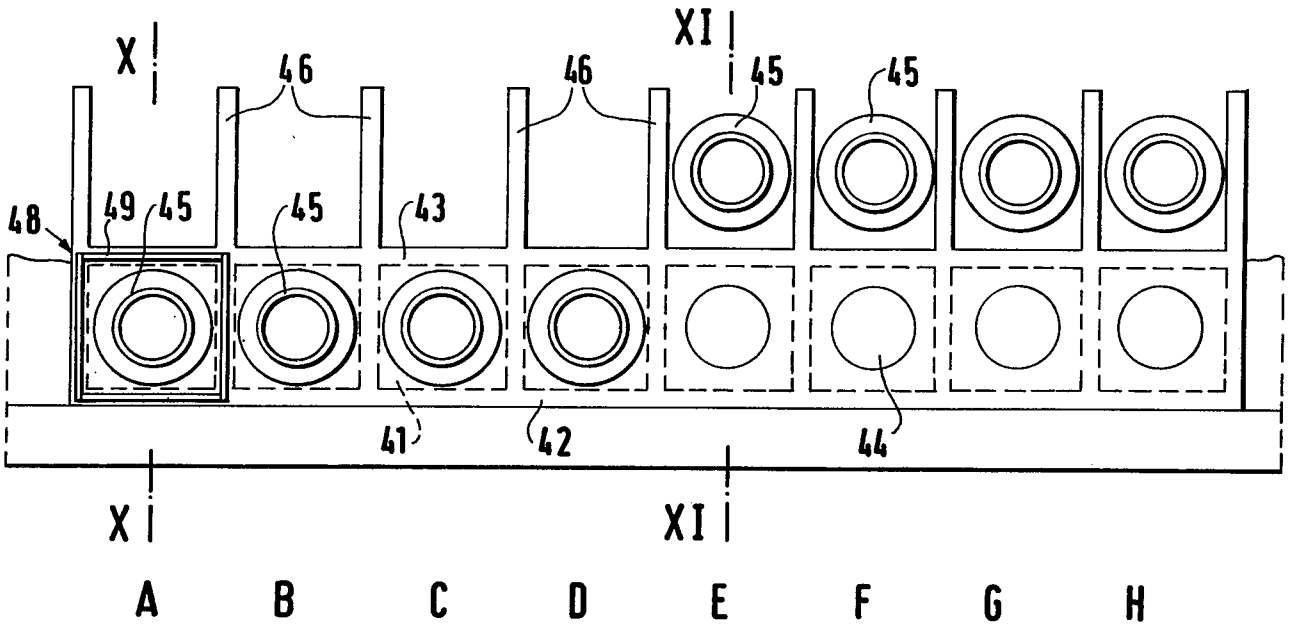
FIG. 9 is a top view of a structure used for manufacturing the float members shown in the above figures.
Figure 10:
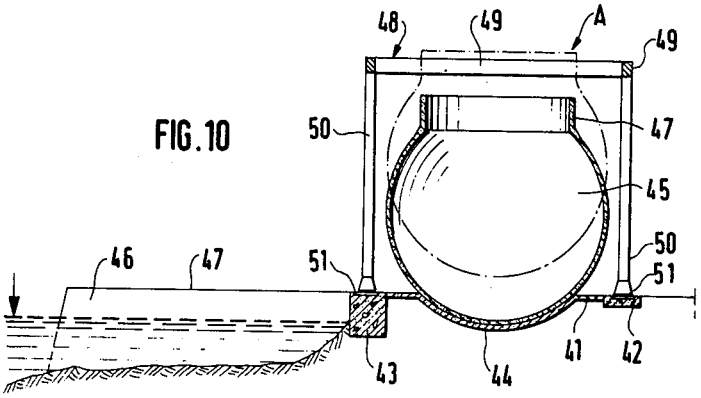
FIG. 10 is a cross sectional view taken along the line X—X in FIG. 9.
Figure 11:
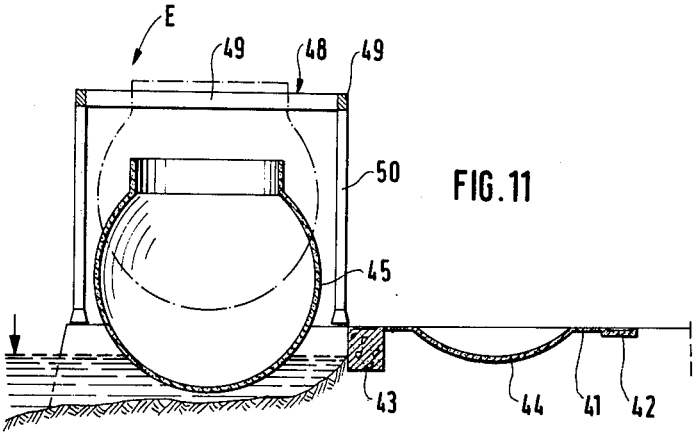
FIG. 11 is a cross sectional view taken along the line XI—XI in FIG. 9.

For the series-production of the float members, a concrete slab with reinforcing abutments 42,43 are provided along a shoreline at a level slightly above the adjacent water level, note FIGS. 10 and 11. As can be seen in FIG. 9, the concrete slab 41 extends over a number of float member construction stations with the number depending on how many float members are to be produced at one time. In FIG. 9, eight such stations A, B, C, D, E, F, G and H are disposed in side-by-side relation. Centrally of each station, the slab 41 is provided with a rounded recess or trough 44 which serves as a form for constructing the lowermost portion of a spherically shaped float. Extending outwardly into the water on each side of the stations are jetties 46 with the upper edge 47 of each jetty being at the same plane as the upper surface of the slab 41 and of the upper surface of the reinforcing abutments, 42,43. Initially, the rounded bottom portion of the float member 45 is formed on the rounded base 44. The remainder of the float member is constructed by means of climbing formwork. Such formwork is not illustrated in the drawing, rather a completed spherically shaped float member 45 is shown in FIG. 10 and 11. In addition, climbing formwork can also be used to form the cylindrically shaped shaft 47 on the upper end of the float member, if necessary.

After the completion of each float member, it must be lifted from the forming station and placed into the water. A supporting frame 48 is used for lifting a finished float member and includes horizontal beams 49 supported on the vertical columns 50. By means of tension members, not shown, inserted into the float member 45, the float member can be suspended on support frame 48 and lifted into the position shown in broken lines. The support frame can then be moved by suitable sliding or driving means 51 outwardly along the top surface 47 of the jetty 46 into position above the free water surface between adjacent jetties at which point the float member 45 is lowered onto the water where it floats and from which position it can be transported for further processing.

Figure 12:
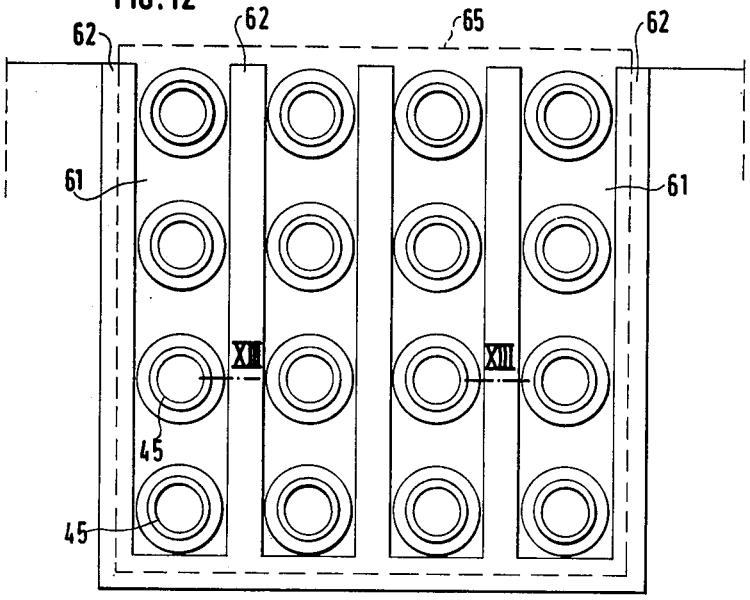
FIG. 12 is a schematic top view of a device for holding the float members and for the construction of the platform across the tops of the float members.
Figure 13:
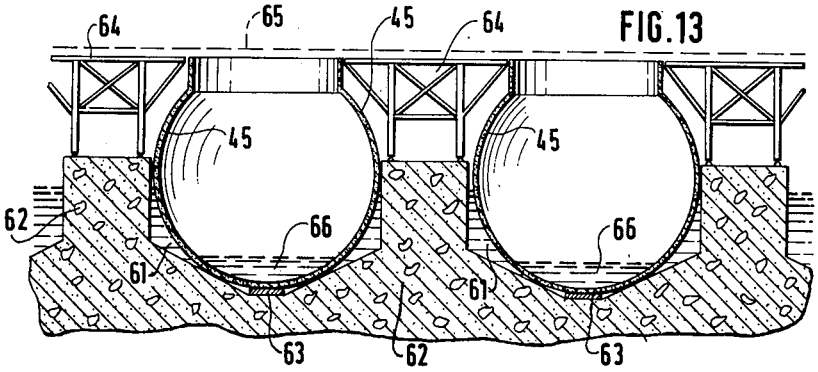
FIG. 13 is a cross sectional view taken along the line XIII—XIII in FIG. 12.

For pouring the top slab or shell onto the upper ends of the float members, a plant is used such as is shown in plan view in FIG. 12 and in cross sectional view in FIG. 13. This plant is constructed along and outwardly from the shoreline. The plant consists of four basins 61 separated from one another by jetties 62. The basins are shaped in cross section so that the constructed float members 45 can be floated into the basins and placed on their lower surfaces by loading the float members, that is, by flooding them with ballast water 66, note FIG. 13. Pads 63 are located in the lower part of each basin. With the float members in place, a prepared scaffold is located along the jetties 62 for use as a form for the lower surface of the platform which can be a solid slab, a hollow slab, or a curved slab in the form of a shell opening upwardly. The formwork is pressed against the exterior of the cylindrically shaped shafts extending upwardly from the float members 45. After placement of the reinforcement, the concrete for the slab 65 is poured in a single operation or in a number of successive operations. After the concrete has set and the slab is prestressed, the completed floating platform is floated by pumping out the ballast water 66.

If the dimensions of the platform being produced exceed the range of conventional lifting equipment which generally has a side length of 150 m, the platform slab or shell can be produced in two rectangularly shaped halves of 150×75 m. The first part of the float member is flooded, turned about a vertical axis and frictionally connected with the second part over tension members, with the corresponding levels being assured by ballasting the float members.

FIGS. 12 and 13 show a plant used for producing a square platform 65 with a total of sixteen float members 45. For the production of a longer platform, for example, a runway as shown in FIGS. 7 and 8, the finished part of the platform is kept at the corresponding level in the area immediately in front of the basins 61 and the jetties 62 by ballasting with water, and the following part of the platform is concreted in a monolithic manner onto subsequent float members.

While specific embodiments of the invention have been shown and described in detail to illustrate the application of the inventive principles, it will be understood that the invention may be embodied otherwise without departing from such principles.

What is claimed is:

1. A floating platform especially for use at offshore locations where the platform may be exposed to significant wind and wave forces and with the platform having a variable water level depending on the loaded condition of the platform, comprising a platform member, said platform member comprising a concrete slab extending transversely of the vertical direction and extending in two directions transversely of one another with said concrete slab being prestressed, said concrete slab having an upper surface and a lower surface and a plurality of float members arranged in a two-directional pattern subjacent to and supporting said concrete slab, wherein the improvement comprises that said concrete slab is prestressed in each of its two transversely extending directions, the variable water level of the platform being located below said concrete slab, said concrete slab including upwardly extending intersecting concrete partitions reinforcing said slab, said slab including said partitions comprising a unitary construction free of joints, said float members formed monolithically with and rigidly attached directly to the lower surface of said concrete slab and being completely closed, said float members are hollow so that each forms a chamber therein and is formed of one of reinforced concrete and prestressed concrete and is shaped at least in part of a closed body of revolution with a curved generatrix and with the water level of the platform located in the range of said float members spaced downwardly from said concrete slab and the lower surface of said concrete slab forming a closure for the upper end of the chamber within each of said hollow float members, means in said concrete slab affording access through the closure of said float members into the chambers therein said float members in the two-directional pattern located directly below and extending across in both directions of the lower surface of said concrete slab and being arranged in adjacent side-by-side rows with said float members being uniformly distributed so that each said float member is located directly below and supports a corresponding uniform part of said concrete slab and in the range of the variable water level said float members being spaced apart in the horizontal direction in the two directions of the two-directional pattern with the horizontal area of each said float members at the water level being significantly less than the horizontal base area o said concrete slab below which said float member i: directly located.

2. A floating platform, as set forth in claim 1, wherei said concrete slab is a planar hollow slab having a continuous upper slab and a continuous lower slab vertically spaced from one another.

3. A floating platform, as set forth in claim 2, wherei said concrete slab being planar with said intersecting partitions extending between said upper slab and said lower slab and dividing the space between said upper and lower slab into a plurality of hollow slab chambers.

4. A floating platform, as set forth in claim 3, wherein said partitions form a rectangular network of hollow slab chambers with said slab chambers being small in size compared to said concrete slab.

5. A floating platform, as set forth in claim 3, wherein said concrete slat being rectangular about the outer periphery thereof and said float members being disposed in a number of parallel rows.

6. A floating platform, as set forth in claim 3, wherein the hollow slab chambers in said concrete slab are formed as chambers for storing liquid.

7. A floating platform, as set forth in claim 3, wherein the hollow slab chambers in said concrete slab are formed as ballast chambers.

8. A floating platform, as set forth in claim 1, wherein the area of the float members at the water line is less than 50% of the area of the horizontal base area of said platform.

9. A floating platform, as set forth in claim 1, wherein said float members each having a vertical axis and being at least partly spherically shaped.

10. A floating platform, as set forth in claim 9, wherein said float members are spherically shaped for the full vertical extent and are connected to said concrete slab about an upper edge formed by cutting a segment from the upper part of a completely spherically shaped member.

11. A floating platform, as set forth in claim 9, wherein at least certain of said float members include a cylindrically shaped hollow shaft monolithically interconnecting the upper edge of the spherically shaped portion of the float member with the lower surface of the concrete slab.

12. A floating platform, as set forth in claim 1, wherein the two directions in which said concrete slab is prestressed extend perpendicularly of one another and said platform member being curved on at least one of two perpendicularly intersecting axes of the two prestressing directions of said concrete slab.

13. A floating platform, as set forth in claim 12, wherein said intersecting partitions extend upwardly from the upper surface of said shell.

14. A floating platform, as set forth in claim 13, wherein said ribs being formed in two groups, one group of said ribs extending radially of the center of said concrete slab and the other group of said ribs extending in concentric circles intersecting said radially extending ribs.

15. A floating platform, as set forth in claim 13, wherein the upper edges of both groups of said ribs are stepped upwardly from the center of said concrete slab toward the radially outer periphery thereof, rising in the manner of an amphitheater.

16. A floating platform, as set forth in claim 12, wherein said concrete slab having a circular periphery and said float members being arranged in radially spaced concentric circular rows.

17. A floating platform, as set forth in claim 12, wherein said platform member being shaped as a portion of a spherically shaped shell open at the top.

18. A floating platform, as set forth in claim 17, wherein said concrete slab being polygonal and said float members being disposed in radially spaced concentric circular rows.

19. A floating platform, as set forth in claim 1, wherein the chambers in said float members are formed as storage tanks for holding liquids such as crude oil and liquid gas.

20. A floating platform, as set forth in claim 1, wherein said concrete slab being arranged as a support for a liquefying plant for natural gas.

21. A floating platform, as set forth in claim 1, wherein said concrete slab being elongated in one direction relative to the other direction for forming an elongated traffic route such as a runway.

* * * * *